US011448082B2

(12) United States Patent
Stoyanov et al.

(10) Patent No.: US 11,448,082 B2
(45) Date of Patent: Sep. 20, 2022

(54) WEAR RESISTANT, SELF-LUBRICATING STATIC SEAL

(71) Applicant: Raytheon Technologies Corporation, Farmington, CT (US)

(72) Inventors: Pantcho P. Stoyanov, West Hartford, CT (US); Kelly M. Harrington, Wethersfield, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 154 days.

(21) Appl. No.: 16/918,348

(22) Filed: Jul. 1, 2020

(65) Prior Publication Data

US 2022/0003125 A1 Jan. 6, 2022

(51) Int. Cl.
*F01D 11/00* (2006.01)
*F01D 25/00* (2006.01)

(52) U.S. Cl.
CPC ..... *F01D 11/005* (2013.01); *F01D 25/005* (2013.01); *F05D 2220/32* (2013.01); *F05D 2240/55* (2013.01); *F05D 2300/141* (2013.01)

(58) Field of Classification Search
CPC ..... F01D 11/00; F01D 11/005; F01D 11/006; F01D 11/008; F01D 25/00; F01D 25/005; F05D 2220/00; F05D 2220/32; F05D 2220/321; F05D 2220/3213; F05D 2220/3215–3219; F05D 2240/00; F05D 2240/55; F05D 2240/58; F05D 2240/581; F05D 2300/00; F05D 2300/14; F05D 2300/141; F05D 2300/17; F05D 2300/172; F05D 2300/175
USPC ..... 277/503
See application file for complete search history.

(56) References Cited

U.S. PATENT DOCUMENTS

| | | | | |
|---|---|---|---|---|
| 8,092,721 | B2 * | 1/2012 | Gatineau | C23C 16/45553 252/521.1 |
| 8,652,589 | B2 * | 2/2014 | Ramm | B65D 25/14 427/580 |
| 9,726,031 | B2 | 8/2017 | Cusack et al. | |
| 9,759,427 | B2 | 9/2017 | Kidder et al. | |
| 2010/0096811 | A1 | 4/2010 | Datta | |
| 2010/0239454 | A1 * | 9/2010 | Johns | C23F 11/161 420/504 |
| 2018/0291815 | A1 | 10/2018 | Munson et al. | |
| 2019/0017401 | A1 * | 1/2019 | Stoyanov | F16J 15/0887 |
| 2019/0107202 | A1 * | 4/2019 | Shah | C22C 19/007 |
| 2020/0056506 | A1 | 2/2020 | Stoyanov et al. | |

OTHER PUBLICATIONS

European search report for patent application No. 21 17 8619.9 dated Nov. 25, 2021.

* cited by examiner

*Primary Examiner* — Nathan Cumar
(74) *Attorney, Agent, or Firm* — Bachman & LaPointe, P.C.

(57) ABSTRACT

A seal assembly for a gas turbine engine includes a seal composed of a nickel-based superalloy; a component in contact with the seal and defining a seal-counterface; and a coating on the seal at the seal-counterface, wherein the coating is a ternary oxide.

16 Claims, 3 Drawing Sheets

WEAR RESISTANT, SELF-LUBRICATING STATIC SEAL

BACKGROUND OF THE DISCLOSURE

The disclosure relates to a piston seal for a gas-turbine engine, more particularly to a wear resistant, self-lubricating seal for a mid-turbine-frame seal location of a gas turbine engine.

Piston rings and seals are utilized in numerous areas in gas turbine engines and can be utilized in areas such as the mid-turbine-frame seal areas which are subject to very high temperatures (approaching 1,600° F.) and also subject to vibratory motion which can lead to significant wear.

One configuration of piston rings for piston seal assemblies is made with nickel-based alloys such as large grain nickel-based superalloy. These materials can be age hardened austenitic nickel-based superalloys which improve creep resistance of the piston ring. However, piston rings made from this nickel-based superalloy still show significant wear to the ring as well as increased wear to the counterface. Specifically, it was found that chromia and alumina formed on the surface of the piston ring, when operated at high temperatures, and this resulted in increased friction leading to additional wear. Thus, the need remains for a piston ring suitable for use under the aforesaid conditions which has acceptable creep and wear resistance when used under these conditions.

SUMMARY OF THE DISCLOSURE

In one non-limiting configuration, a seal assembly for a gas turbine engine comprises a seal comprised of a nickel-based superalloy; a component in contact with the seal and defining a seal-counterface; and a coating on the seal at the seal-counterface, wherein the coating comprises a ternary oxide.

In another non-limiting configuration, the ternary oxide contains a metal oxide that forms nanoparticles when subjected to sliding or vibratory motion.

In still another non-limiting configuration, the ternary oxide comprises a silver-based ternary oxide.

In a further non-limiting configuration, the silver-based ternary oxide is selected from the group consisting of $Ag_3VO_4$, $AgTaO_3$, $Ag_2MoO_4$ and combinations thereof.

In a still further non-limiting configuration, the ternary oxide comprises a copper-based ternary oxide.

In another non-limiting configuration, the copper-based ternary oxide is selected from the group consisting of $CuTa_2O_6$, $CuTaO_3$, $CuMoO_4$ and combinations thereof.

In still another non-limiting configuration, the ternary oxide is a calcium ternary oxide.

In a further non-limiting configuration, the calcium ternary oxide is selected from the group consisting of $CaSO_4$, $CaWO_4$, $CaMoO_4$ and combinations thereof.

In a still further non-limiting configuration, the coating is a thermal spray coating having a thickness of between 0.5 and 10 mils.

In another non-limiting configuration, the coating is a PVD coating and has a thickness of between 0.004 and 1.5 mils.

In still another non-limiting configuration, the seal comprises an age hardening austenitic nickel-based superalloy.

In a further non-limiting configuration, the seal has non-contact surfaces that are not in contact with the component, and the coating is on the seal at the seal-counterface, and not on the non-contact surfaces.

In a still further non-limiting configuration, the component comprises two components, with the seal mounted between the two components to define two seal-counterfaces, and the coating is on the seal at both of the two seal-counterfaces.

In another non-limiting configuration, the two components comprise a mid-turbine-frame (MTF) vane and an outer air seal.

A further non-limiting configuration is a seal for a gas turbine engine, comprising a seal comprised of a nickel-based superalloy and a coating on the seal, wherein the coating comprises a ternary oxide.

In another non-limiting configuration, the ternary oxide contains a metal oxide that forms nanoparticles when subjected to sliding or vibratory motion.

In still another non-limiting configuration, the ternary oxide comprises a silver-based ternary oxide.

In a further non-limiting configuration, the silver-based ternary oxide is selected from the group consisting of $Ag_3VO_4$, $AgTaO_3$, $Ag_2MoO_4$ and combinations thereof.

In a still further non-limiting configuration, the ternary oxide comprises a copper-based ternary oxide.

In another non-limiting configuration, the copper-based ternary oxide is selected from the group consisting of $CuTa_2O_6$, $CuTaO_3$, $CuMoO_4$ and combinations thereof.

The details of one or more embodiments of the disclosure are set forth in the accompanying drawings and the description below. These embodiments, and features thereof, can be considered separately and also in combination within the scope of this disclosure. Other features, objects, and advantages of the disclosure will be apparent from the description and drawings, and from the claims.

BRIEF DESCRIPTION OF THE DRAWINGS

A detailed description of preferred embodiments of the disclosure follows, with referenced to the attached drawings, wherein.

Like reference numbers and designations in the various drawings indicate like elements.

DETAILED DESCRIPTION

The present disclosure relates to a piston seal assembly and, more particularly, to a piston seal assembly for a gas turbine engine which can be utilized in areas of high temperature and high vibratory motion. The seal assembly as disclosed herein possesses excellent creep and wear resistance at high temperatures.

Figure 1:
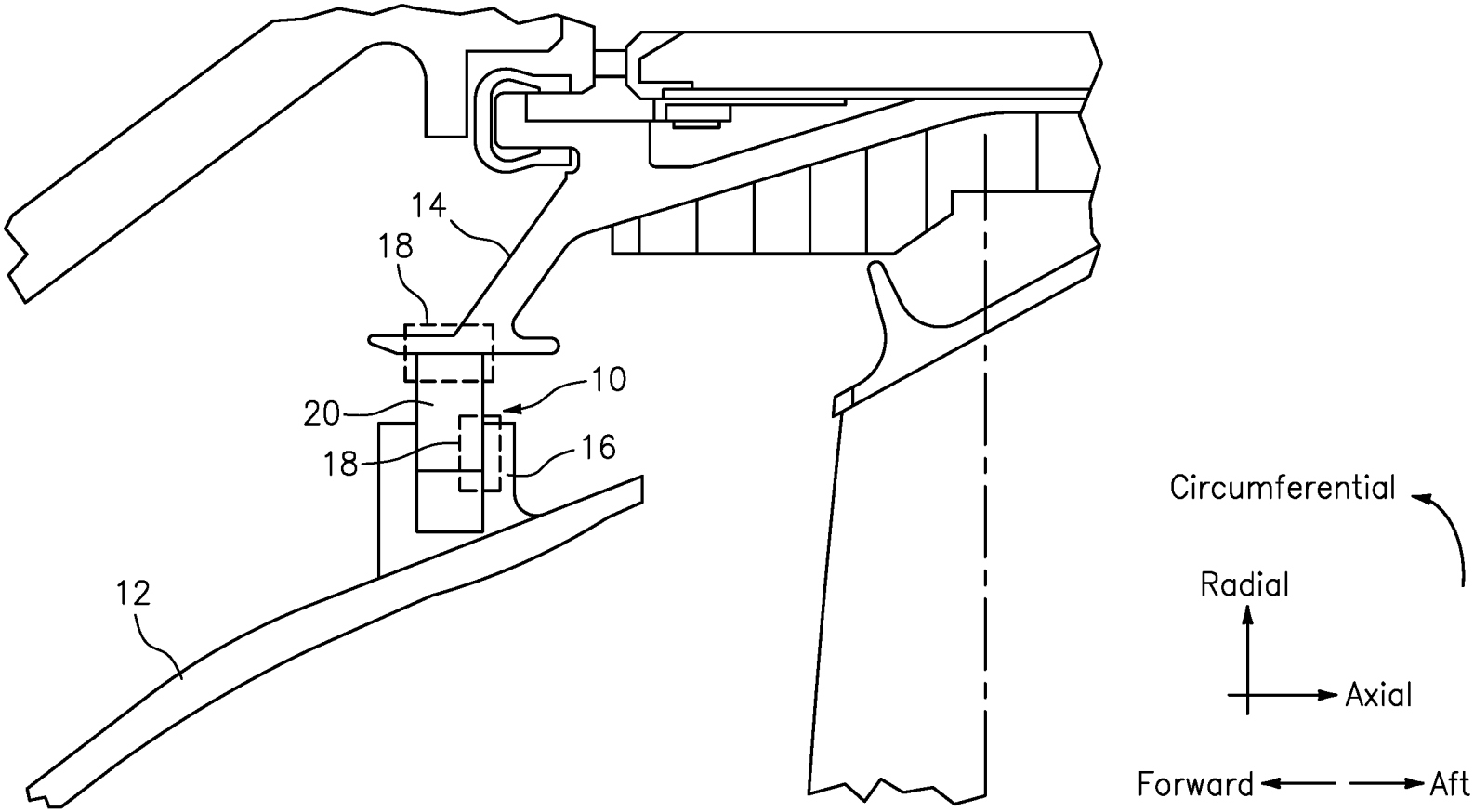
FIG. 1 shows a mid-turbine-frame (MTF) piston seal assembly.

FIG. 1 shows a mid-turbine-frame (MTF) location of a gas-turbine engine, and shows a seal assembly 10 positioned between an MTF vane 12 and an outer air seal 14. MTF vane 12 can suitably have a counterface component 16 for holding a seal such as a seal ring, illustrated as seal body 20, such that seal body 20 is in sealing contact with counterface component 16 and also with outer air seal 14.

Areas of contact between seal body 20 and components such as counterface component 16 or outer air seal 14 establish seal-counterface areas 18 between the seal and these structures, and these seal-counterface areas are subjected to significant vibratory motion, which, as mentioned above can lead to problems of creep and high wear, particularly when subjected to high temperatures, for example approaching 1600° F.

FIG. 1 shows only a portion of the gas turbine engine for which the seal assembly can be utilized, and radial, axial and circumferential directions as well as forward and aft vectors related to the engine are all as shown in FIG. 1. Also, FIG. 1 illustrates one area where a seal and seal assembly as disclosed herein can be implemented. It should be appreciated that this is by way of example, and that the seal and seal assembly of this disclosure could be utilized in numerous other areas and different types of engines and the like.

The present disclosure relates to a coating strategy which is utilized on seal body 20 at the seal-counterface areas 18 to address creep and wear, especially wear, at these areas when operated at high temperatures. Coating can be applied to the counterface as well, all as described below.

Figure 2:
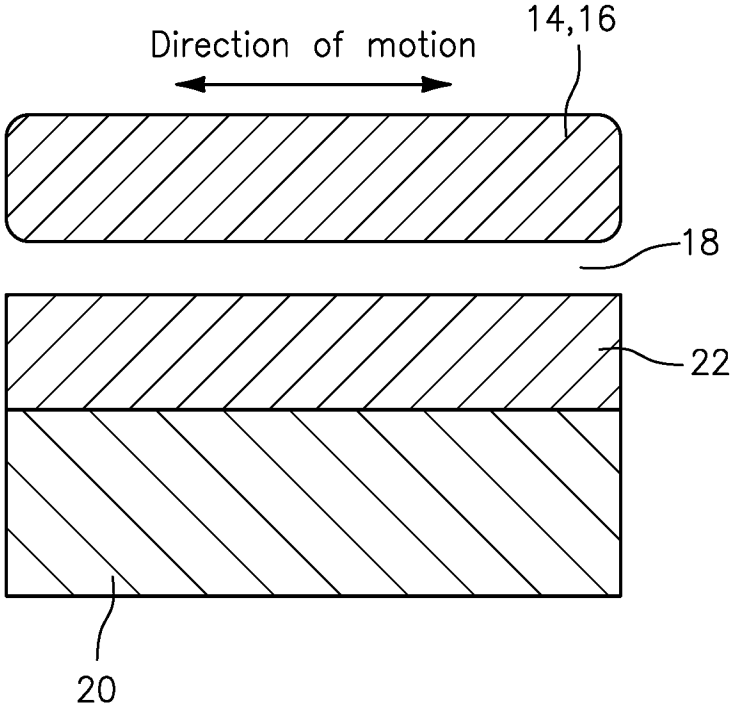
FIG. 2 schematically illustrates one configuration of a coated seal member.

FIG. 2 shows an enlarged portion of a seal body 20 of a seal assembly 10 wherein the seal body 20 has a coating 22 applied thereto. As disclosed herein, coating 22 is a coating of ternary oxides. During use in engine operating conditions, oxides from the coating break down and form nanoparticles that act as a solid lubricant, producing desirable properties at the interface or seal-counterface area 18. The coating produces a low friction, wear resistant piston seal that is effective when operating at temperatures up to 1,600° F., for example in the range of 600-1,600° F., under fretting and sliding type contact, or vibration.

In one configuration, the seal body 20 can be a nickel-based superalloy, more particularly, an age hardening austenitic nickel-based superalloy such as Waspaloy™. Seal bodies made from this material have been found to help address creep resistance, but still to have issues due to wear. Coatings such as those disclosed herein help to prevent this wear.

Figure 3:
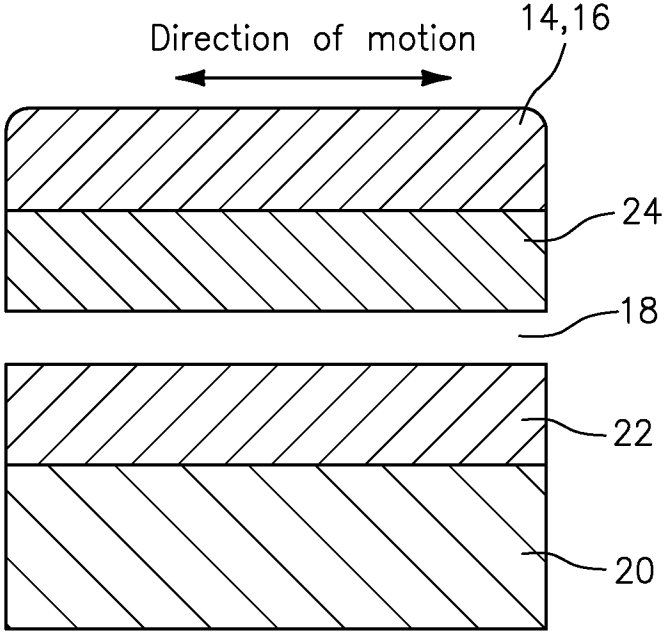
FIG. 3 schematically illustrates another configuration with a coating seal member and a coated counterface.

FIG. 3 shows another configuration wherein a coating 24 is also applied to the counterface component 14, 16.

Coating 22, 24 can be applied to seal body 20 and counterface component 14, 16 at portions or areas corresponding to seal-counterface areas 18, where seal body 20 contacts components such as counterface component 16 and outer air seal 14. Alternatively, coating can be applied to an entire seal body and/or portion of a counterface component, depending upon manufacturing concerns and cost of materials.

Coating 22, 24 is a ternary oxide applied via thermal spray, PVD or the like, to form a nanostructured coating, that is, a coating with features such as grain size, particles, etc., having a size in the nano-meter range.

In one non-limiting configuration, the ternary oxide is a silver-based ternary oxide. Suitable examples of a silver-based ternary oxide include but are not limited to $Ag_3VO_4$, $AgTaO_3$, $Ag_2MoO_4$ and combinations thereof. In a silver-based ternary oxide, it is believed, without being bound by any particular theory, that the oxides break down to form silver nanoparticles that act as a solid lubricant, with remaining $VO_4$ or $Ta_2O_6$ helping to define the wear surface. Silver-based coatings are desirable as it is believed that the silver particles stay near the surface and produce excellent lubrication properties at relatively low temperatures.

In another non-limiting configuration, the ternary oxide can be a copper-based ternary oxide such as $CuTa_2O_6$. Other examples of suitable copper-based ternary oxides include $CuTaO_3$, $CuMoO_4$ and the like. Copper-based coatings balance hardness and lubricity, and may not be as lubricious as silver at low temperatures. Nevertheless, the hardness of copper helps to balance this. When the copper-based ternary oxide breaks down, the remaining $Ta_2O_6$ has excellent shear properties that help with the lubricity as desired, particularly with a hard underlying metallic substrate.

In a further non-limiting configuration, the ternary oxide can be a calcium ternary oxide such as $CaSO_4$, $CaWo_4$, $CaMoO_4$ and combinations thereof.

Coatings of ternary oxide following the disclosed strategy can be applied in relatively thin coating thicknesses, for example between 0.5 and 10 mils, and more particularly between 1 and 7 mils, when the coating is a thermal spray coating. Other application techniques can lead to different coating thicknesses. For example, when using physical vapor deposition (PVD) or similar processes, coatings can be applied having a thickness between 0.004 mils (approximately 100 nm) and 1.5 mils.

Figure 5:
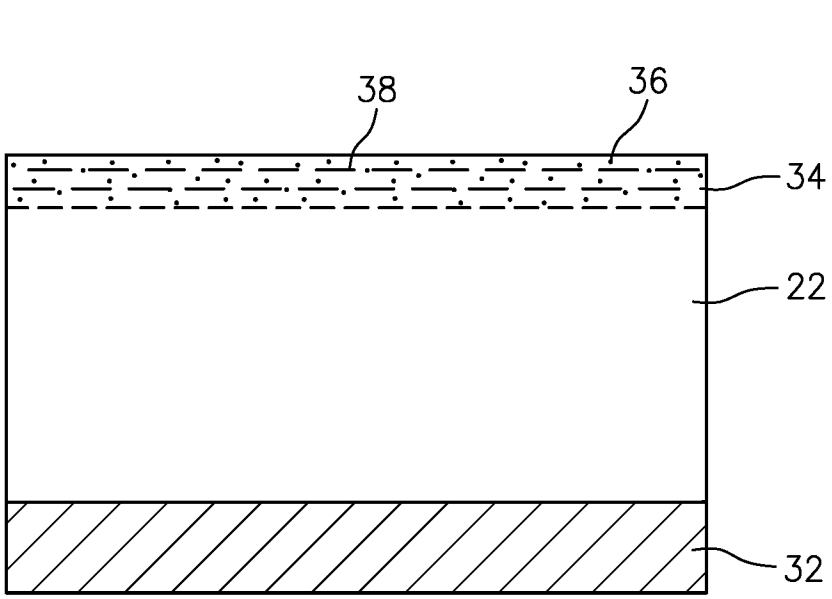
FIG. 5 illustrates, in comparison to FIG. 4, the lubricious coating formed as disclosed, wherein there is little or no break in period.
Figure 4:
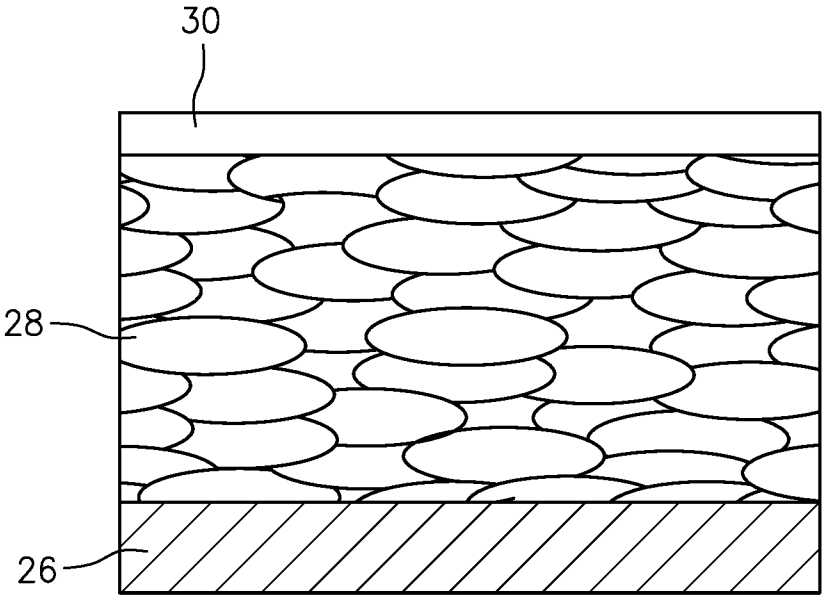
FIG. 4 illustrates formation of a lubricious layer during a break in period with a known seal strategy.

Referring to FIGS. 4 and 5, a comparison is presented of a typically coated surface (FIG. 4) and a coated surface as disclosed herein (FIG. 5). In FIG. 4, a substrate 26 has a coating 28 which can be a known coating that is intended to form a film 30 during use, wherein the film 30 creates the desired lubricity. There is a break in period during which film 30 is formed, and during this break in period, there can be elevated friction and heat, with potentially undesirable effects on the surfaces, possible formation of chromia or alumina, elevated temperatures, and damage to the seal.

FIG. 5 shows a substrate 32 having a coating 22 as disclosed herein, wherein the coating 22 already has desirable properties, without requiring the formation of a film such as film 30 of FIG. 4. During use, the ternary oxide coating 22 as disclosed herein (FIG. 5) forms a subsurface region 34 wherein the ternary oxides break down to form metal nanoparticles 36 and remaining binary oxides 38 that help produce lubricity. Thus, with a ternary oxide coating as disclosed herein, there is little or no break in period, which leads to significantly reduced chance of damage to the seal and related components during operation.

Ex situ analysis of surfaces coated with ternary oxide as disclosed herein has shown the behavior of silver and copper-based ternary oxides, wherein silver or copper nanoparticles, which can form into clusters, form a solid lubricant, while the remaining binary oxide, for example $Ta_2O_5$, also adds to the lubricity properties of the coating. During use, the ternary oxides break down to form metal nanoparticles (silver, copper or calcium, for example) as well as a remaining binary oxide (vanadium or tantalum oxide, for example). It is believed that the remaining binary oxide can provide additional lubrication as well as hardening effect, in some cases, both of which contribute to wear resistance.

It should be appreciated that while different classes of ternary oxides are described separately herein, specifically silver, copper and calcium based ternary oxides, coatings can suitably be formulated using mixtures of these different ternary oxides. Further, other ternary oxides could be substituted by a person having ordinary skill in the art within the scope of this disclosure.

As mentioned above, in one non-limiting configuration, the seal body 20 can be made of or comprise a nickel-based superalloy, more specifically an age hardening austenitic nickel-based superalloy, one suitable example of which is Waspaloy™, although other nickel-based superalloys may be suitable as well, particularly those with a large grain size.

It should be appreciated that a piston seal according to the present disclosure, which can typically be in a ring form, can be positioned between various components, such as in the counterface component 16 and contacting outer air seal 14 as shown in FIG. 1. Seal body 20 will have areas where contact is made with other components, and other non-contact areas which are not in contact with any other structures. While the entire seal body could be coated with the coating composition disclosed herein, it may be preferable in order to conserve resources and avoid excessive weight to apply the coating to the seal only in the areas of contact with the other components, specifically at the seal-counterfaces 18.

The lubrication strategy disclosed herein, utilizing a ternary oxide coating, provides wear resistance even at high temperatures, and thereby produces low friction, wear resistant, and self lubricating piston rings or seals capable of operating efficiently in high pressure turbine static sealing applications. This will significantly increase endurance life of engine components, and may significantly reduce overhaul costs by reducing the number of parts, in particularly the more expensive counterface parts, that can conventionally be stripped due to wear and thermal damage issues, for example caused by frictional heating.

The present disclosure is made in terms of a seal assembly wherein the seal is between two components at a mid-turbine-frame (MTF) location, for example in the high pressure turbine. It should be appreciated that the seal assembly, as well as the specific coating and lubrication strategy utilized in the disclosed seal assembly, could have useful application in other areas and locations of a gas turbine engine as well, particularly areas where the combined conditions of high temperature and significant vibratory motion are experienced.

One or more embodiments of the present disclosure have been described. Nevertheless, it will be understood that various modifications may be made without departing from the spirit and scope of the disclosure. For example, different materials and seal configurations could be utilized, and seals in other locations may benefit from the disclosure coating. Accordingly, other embodiments are within the scope of the following claims.

What is claimed is:

1. A seal assembly for a gas turbine engine, comprising:
- a seal comprised of a nickel-based superalloy;
- a component in contact with the seal and defining a seal-counterface; and
- a coating on the seal at the seal-counterface, wherein the coating comprises a ternary oxide, wherein the ternary oxide comprises a silver-based ternary oxide, and wherein the silver-based ternary oxide is selected from the group consisting of $Ag_3VO_4$, $AgTaO_3$, $Ag_2MoO_4$ and combinations thereof.

2. The assembly of claim 1, wherein the ternary oxide contains a metal oxide that forms nanoparticles when subjected to sliding or vibratory motion.

3. The assembly of claim 1, wherein the coating is a thermal spray coating having a thickness of between 0.5 and 10 mils.

4. The assembly of claim 1, wherein the coating is a PVD coating and has a thickness of between 0.004 and 1.5 mils.

5. The assembly of claim 1, wherein the seal comprises an age hardening austenitic nickel-based superalloy.

6. The assembly of claim 1, wherein the seal has non-contact surfaces that are not in contact with the component, and the coating is on the seal at the seal-counterface, and not on the non-contact surfaces.

7. The seal assembly of claim 1, wherein the component comprises two components, with the seal mounted between the two components to define two seal-counterfaces, and wherein the coating is on the seal at both of the two seal-counterfaces.

8. The assembly of claim 7, wherein the two components comprise a mid-turbine-frame (MTF) vane and an outer air seal.

9. A seal assembly for a gas turbine engine, comprising:
- a seal comprised of a nickel-based superalloy;
- a component in contact with the seal and defining a seal-counterface; and
- a coating on the seal at the seal-counterface, wherein the coating comprises a ternary oxide, wherein the ternary oxide comprises a copper-based ternary oxide, wherein the copper-based ternary oxide is selected from the group consisting of $CuTa_2O_6$, $CuTaO_3$, $CuMoO_4$ and combinations thereof.

10. The assembly of claim 9, wherein the ternary oxide contains a metal oxide that forms nanoparticles when subjected to sliding or vibratory motion.

11. A seal assembly for a gas turbine engine, comprising:
- a seal comprised of a nickel-based superalloy;
- a component in contact with the seal and defining a seal-counterface; and
- a coating on the seal at the seal-counterface, wherein the coating comprises a ternary oxide, wherein the ternary oxide is a calcium ternary oxide, wherein the calcium ternary oxide is selected from the group consisting of $CaSO_4$, $CaWO_4$, $CaMoO_4$ and combinations thereof.

12. A seal for a gas turbine engine, comprising a seal comprised of a nickel-based superalloy and a coating on the seal, wherein the coating comprises a ternary oxide, wherein the ternary oxide contains a metal oxide that forms nanoparticles when subjected to sliding or vibratory motion, wherein the ternary oxide comprises a silver-based ternary oxide, and wherein the silver-based ternary oxide is selected from the group consisting of $Ag_3VO_4$, $AgTaO_3$, $Ag_2MoO_4$ and combinations thereof.

13. The seal of claim 12, wherein the ternary oxide contains a metal oxide that forms nanoparticles when subjected to sliding or vibratory motion.

14. A seal for a gas turbine engine, comprising a seal comprised of a nickel-based superalloy and a coating on the seal, wherein the coating comprises a ternary oxide, wherein the ternary oxide comprises a copper-based ternary oxide, and wherein the copper-based ternary oxide is selected from the group consisting of $CuTa_2O_6$, $CuTaO_3$, $CuMoO_4$ and combinations thereof.

15. The seal of claim 14, wherein the ternary oxide contains a metal oxide that forms nanoparticles when subjected to sliding or vibratory motion.

16. A seal for a gas turbine engine, comprising a seal comprised of a nickel-based superalloy and a coating on the seal, wherein the coating comprises a ternary oxide, wherein the ternary oxide is a calcium ternary oxide, and wherein the calcium ternary oxide is selected from the group consisting of $CaSO_4$, $CaWO_4$, $CaMoO_4$ and combinations thereof.

* * * * *